US006006363A

United States Patent [19]

Karlin

[11] Patent Number: 6,006,363

[45] Date of Patent: Dec. 28, 1999

[54] COMPRESSION SHORT WITH MAGNET POCKET

[75] Inventor: Terry J. Karlin, Hays, Kans.

[73] Assignee: Stromgren Supports, Inc., Hays, Kans.

[21] Appl. No.: 09/132,451

[22] Filed: Aug. 11, 1998

[51] Int. Cl.[6] ..... A41D 1/06

[52] U.S. Cl. ..... 2/228; 2/247; 600/15

[58] Field of Search ..... 2/79, 227, 247, 2/228, 238, 400, 404, 407; 600/15

[56] References Cited

U.S. PATENT DOCUMENTS 5,161,257 11/1992 Arensdorf et al. .

*Primary Examiner*—Diana Oleksa
*Assistant Examiner*—Kate Moran
*Attorney, Agent, or Firm*—Chase & Yakimo, L.C.

[57] ABSTRACT

A compression short with a magnet pocket for relieving back and hip pain includes a garment of resilient fabric shaped to compliment the pelvic region and legs which presents an upper edge and has a waistband joined to the upper edge. A pocket panel is secured to the inner surface of the garment at the back thereof to form a pocket within the shorts. The pocket has a central portion and a pair of opposed elongated arms. The central portion extends substantially longitudinally adjacent the wearer's tailbone, and the arms extend laterally from opposite sides of the central portion adjacent the wearer's hips. The central portion and the arms are adapted to selectively receive a magnet of complemental shape therein to relieve pain at the wearer's back, tailbone and hip areas. The pocket configuration allows for easy insertion and removal of the magnets and also secures the magnets in the proper place over the wearer's back and hips.

9 Claims, 1 Drawing Sheet

COMPRESSION SHORT WITH MAGNET POCKET

FIELD OF THE INVENTION

This invention relates to improvements in compression shorts. More specifically, the shorts are provided with a pocket designed and configured to receive magnets of complemental shape therein to aid in relieving pain in the pelvic region.

BACKGROUND OF THE INVENTION

Compression shorts or pants have become widely used and accepted as a garment for active individuals and athletes engaged in sports and physical activity ranging from walking to football. The basic function of compression shorts is to serve as an athletic girdle and support the muscles of the abdomen, lower back and thighs. This is accomplished through the use of stretch fabric which is placed in tension as the pant is pulled into position on the wearer's body. Typically available in either thigh or knee-length styles and in various colors, compression shorts are soothing and comfortable as well as fashionable and functional and are ideal for groin, quad, hamstring and stomach muscle compression.

Active individuals and athletes that commonly wear compression shorts may develop muscle or joint pain in various regions of the pelvic area, such as the lower back and hips, possibly resulting from injury, arthritis, stress or overuse. It is believed by some that such pain responds to magnetic fields. For instance, one study published by the American Congress of Rehabilitation Medicine and the American Academy of Physical Medicine and Rehabilitation in November 1997 entitled "Response of Pain to Static Magnetic Fields in Postpolio Patients: A Double-Blind Pilot Study", found that the application of a device delivering static magnetic fields of 300 to 500 Gauss over a pain trigger point results in significant and prompt relief of pain in postpolio patients suffering from myofascial and arthritic pain.

As a result, magnetic products designed to provide pain relief are quickly gaining popularity. "Magnet Therapy" is used among athletes and other active individuals for relief from and prevention of injuries and other ailments.

SUMMARY OF THE INVENTION

It is, therefore, a primary object of the subject invention to provide compression shorts having a pocket formed therein configured for receipt of magnets to relieve a wearer's back and hip pain.

Another important object of the subject invention is to provide compression shorts with a pocket formed by a panel of resilient material secured to the shorts and having a central portion open at the waistband and opposed elongated arm portions, where the central portion extends substantially longitudinally adjacent a wearer's tailbone and the arm portions extend laterally from the central portion adjacent the wearer's hips, each portion of the pocket being adapted to selectively receive a magnet of complemental shape therein for relief from back and hip pain.

Yet another important object of the subject invention is to provide compression shorts with a pocket for magnets, which pocket maintains the magnets in the proper position over the tailbone and hip regions.

Still another object of the subject invention is to provide compression shorts with a pocket for magnets that is easily accessible for easy insertion and removal of the magnets from the shorts.

Other objects will become apparent as the detailed description proceeds.

DETAILED DESCRIPTION

Figure 1:
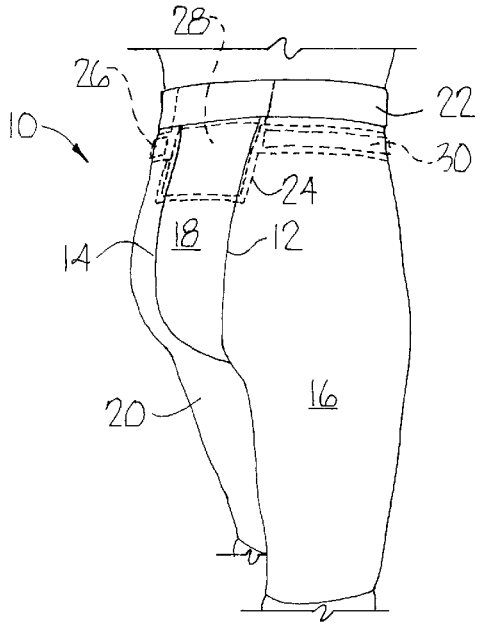
FIG. 1 is a rear and right side perspective view illustrating the compression short of the present invention on a wearer, the broken lines defining the edges of the pocket and also showing the location of magnets therein.
Figure 2:
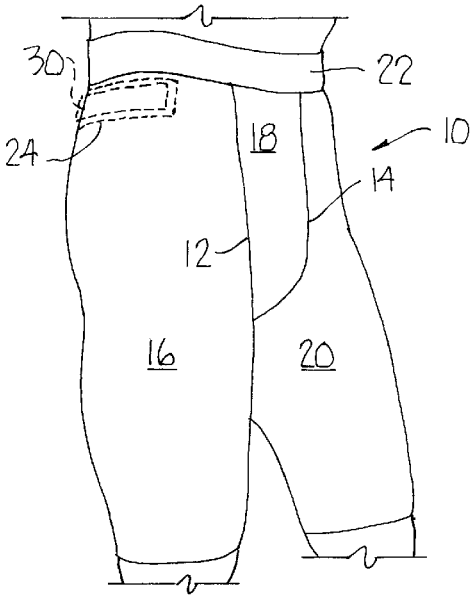
FIG. 2 is a perspective view of the front and right side of the garment as worn, the broken lines showing the edges of the pocket and the edges of a magnet therein.

Referring to FIGS. 1 and 2, the compression shorts 10 of the present invention are shown in place on the body of a wearer. The compression shorts 10 illustrated are a knee-length football girdle. The garment has three sections stitched together at main seams 12 and 14, a right pelvis section 16, a crotch section 18 and a left pelvis section 20. The main seams 12 and 14 extend from the front of a waistband 22 down under the crotch and up to the back of the waistband 22 as may be appreciated from a comparison of FIGS. 1 and 2. The waistband 22 is securely fastened by stitching to the upper edge of the body sections 16, 18 and 20. The edge or outline of a tailbone/hip pocket is shown at 24 in FIGS. 1 and 2, and for purposes of illustration, permanent magnet pads or plates 26, 28 and 30 are shown in broken lines inserted into and held within the pocket of the shorts 10.

The body sections 16, 18 and 20 are made from a highly resilient fabric preferably a blend of 75 percent nylon and 25 percent Lycra® (a registered trademark of DuPont) having a rating of approximately 280 denier. This provides a fabric having four-way stretchability and the capability of elongation of its fibers to over twice their normal length without exceeding the elastic limit of the fabric. The utilization of a four-way stretch fabric provides the shorts with the compression characteristics necessary for effective compression support of the underlying muscles of the wearer.

The magnets 26, 28 and 30 are preferably unipole magnet pads such as those sold under the trademark MagnetRelief®. Unipole magnets are polarized with negative energy on one side and positive energy on the opposite side. When both positive and negative energy are present on the same side of a magnet, the magnet is referred to as bipolar. Apparently, the positive and negative fields of magnetism have opposite effects on the human body. It is claimed that the negative field normalizes and calms, while the positive field overstimulates and excites. More specifically, the negative field is claimed to increase cellular oxygen, increase blood flow and circulation, encourage sleep, fight infection, reduce inflammation, relieve and reduce fluid retention. On the other hand, the positive field is claimed to decrease cellular oxygen, accelerate bacteria growth, increase inflammation, increase pain and stimulate weightfullness, among other things.

Figure 3:
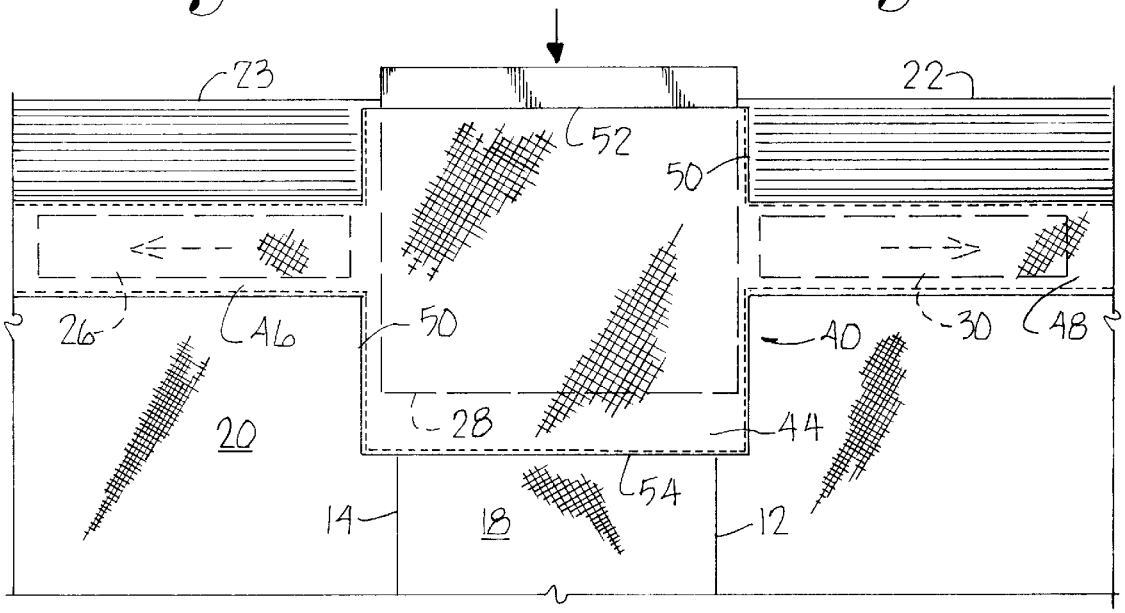
FIG. 3 is an enlarged, fragmentary, detail view showing the manner of attachment of the pocket to the inner surface of the compression short and the placement of magnets therein.

Now referring to FIG. 3, a method of attachment of the pocket of the present invention is illustrated. A pocket panel 40 is preferably composed of the same nylon/Lycra® fabric as the body sections 16, 18 and 20 and forms the pocket of the illustrated garment. The pocket panel 40 is secured to the inner surface 42 of the compression shorts 10 at the back thereof and includes a generally rectangular-shaped central portion 44 and arms or canals 46 and 48 which extend from opposite sides of the generally rectangular-shaped central portion 44 between the top and bottom edges 52 and 54 thereof. More specifically, the central portion 44 is secured preferably over the back crotch section 18 with the arms 48 and 46 extending in opposed directions outwardly from the sides thereof over the right and left leg sections 16 and 20 adjacent or just below the waistband 22. Thus, the central portion 44 extends substantially longitudinally of the tailbone and the arms 46 and 48 extend laterally therefrom.

The pocket panel 40 is secured to the shorts 10 by stitching which extends along the side edges 50 of the central portion 44 (except where the arms extend outwardly therefrom) and along the bottom edge 54 of the central portion 44. Also, stitching extends around each edge of the arms 46 and 48, except at the side where arms 46 and 48 meet the central portion 44. Thus, the top edge 52 of the central portion 44 remains unstitched and open for insertion of the magnets 26, 28 and 30 into the pocket, and the central portion 44 communicates with each arm 46 and 48 since no stitching divides the pocket panel 40.

The panel 40 is positioned on shorts 10 with an upper portion of the central portion 44 being stitched directly to the waistband 22, the lower portion, beneath the arms 46 and 48, being stitched directly to the shorts 10 and with the arms 46 and 48 being stitched and secured to the shorts 10 adjacent to or directly beneath the waistband 22. Preferably, the top edge 52 of the central portion 44 is substantially aligned with the top edge 23 of the waistband 22.

This pocket configuration allows magnets of complemental shape to the arms 46 and 48 and the central portion 44 to be selectively inserted into the desired area of the pocket. More specifically, elongated magnets 26 and 30 can be inserted into the arms 46 and 48 to help alleviate hip pain. The larger rectangular magnet 28 can be inserted into the pocket at the central portion 44 to help alleviate back and tailbone pain. If a magnet is desired in each area of the pocket, the arrows shown in FIG. 3 illustrate the insertion process.

As it may be clear, having the top edge 52 of the central portion 44 aligned with the top edge 23 of the waistband 22 facilitates the insertion and removal of the magnets 26, 28 and 30. This pocket configuration also maintains the magnets 26, 28 and 30 in place within the pocket. More specifically, magnet 28 helps prevent either of magnets 26 or 30 from becoming dislodged, and the waistband 22 helps prevent the magnet 28 within the central portion 44 from becoming dislodged. The resiliently flexible nature of both the pocket panel 40 and the compression shorts 10 also helps maintain the positioning of the magnets 26, 28 and 30.

Having thus described the invention, what is claimed as new and desired to be secured by Letters Patent is as follows:

1. A compression short, comprising:

a garment of resilient fabric shaped to compliment the pelvic region and legs of the wearer, said garment including a multi-chamber pocket and a waistband;

said pocket having a central portion which presents a first chamber and opposed elongated arm portions which present second and third chambers and communicate with said central portion, said central portion being adapted to extend substantially longitudinally adjacent a wearer's tailbone and said arm portions adapted to extend laterally from said central portion adjacent a wearer's hips;

said central portion having a top edge unattached to said garment, presenting a pocket opening through which magnets may be inserted into said pocket;

said central portion and said arms being adapted to selectively receive magnets therein to relieve pain at the wearer's pelvic region.

2. A compression short as claimed in claim 1 wherein said pocket is formed by a single panel of resilient fabric secured to said garment.

3. A compression short as claimed in claim 2 wherein said panel is secured to an inner surface of said garment at the back thereof.

4. A compression short as claimed in claim 1 wherein said top edge of said central portion is in general alignment with a top edge of said waistband to facilitate insertion of a magnet into said pocket.

5. A compression short as claimed in claim 1 wherein said arm portions are secured below said waistband to help maintain any magnet placed therein in position.

6. A compression short, comprising:

a garment of resilient fabric shaped to compliment the pelvic region and legs of a wearer and presenting an upper edge;

a waistband joined to said upper edge of the garment;

a pocket panel of resilient fabric;

attachment means for anchoring said panel to said waistband and said garment to form a multi-chamber pocket;

said pocket having a central portion presenting a first chamber, a pair of opposed elongated arms presenting second and third chambers adapted to extend outwardly from corresponding sides of said central portion, and a pocket opening between said waistband and said central portion, said central portion adapted to extend substantially longitudinally adjacent a wearer's tailbone and said arms extending laterally adjacent a wearer's hips;

said central portion and said arms being adapted to selectively receive a plurality of magnets therein to relieve pain at the wearer's hip and tailbone region;

a top edge of said central portion being in general alignment with a top edge of said waistband to facilitate insertion of a magnet into said pocket;

said arms being secured to said garment beneath said waistband to help maintain a magnet placed therein in position.

7. A compression short as claimed in claim 6 wherein said pocket panel is secured to an inner surface of said garment.

8. A compression short, comprising:

a garment of resilient fabric shaped to compliment the pelvic region and legs of the wearer, said garment including a waistband and a multi-chamber pocket adjacent the waistband;

said pocket having a central portion presenting a first chamber and opposed elongated arm portions presenting second and third chambers which communicate with said central portion, said central portion adapted to extend substantially longitudinally adjacent a wearer's tailbone and said arm portions adapted to extend laterally from said central portion adjacent a wearer's hips;

said central portion having a top edge unattached to said garment, presenting a pocket opening; and a magnet of complemental shape selectively received by said central portion or one of said arms upon insertion through said pocket opening, whereby to relieve pain at the wearer's pelvic region.

9. A compression short as claimed in claim 8 further comprising at least one additional magnet of complemental shape selectively received by said central portion or arms.

* * * * *

UNITED STATES PATENT AND TRADEMARK OFFICE

CERTIFICATE OF CORRECTION

PATENT NO. : 6,006,363
DATED : December 28, 1999
INVENTOR(S) : Terry J. Karlin

It is certified that error appears in the above-identified patent and that said Letters Patent is hereby corrected as shown below:

Column 4,
Line 23, delete "adapted to extend" and insert -- extending --.
Line 28, delete "extending" and insert -- adapted to extend --.

Signed and Sealed this

First Day of January, 2002

*Attest:*

*Attesting Officer*

JAMES E. ROGAN
*Director of the United States Patent and Trademark Office*